US005551713A

United States Patent [19]

Alexander

[11] Patent Number: 5,551,713

[45] Date of Patent: Sep. 3, 1996

[54] SHOCK ABSORBING BLADE ROLLER SKATES

[76] Inventor: Joshua Alexander, P.O. Box 40511, Pasadena, Calif. 91114

[21] Appl. No.: 490,029

[22] Filed: Jun. 13, 1995

[51] Int. Cl.[6] ..... A63C 17/00

[52] U.S. Cl. ..... 280/11.19; 280/11.27; 280/11.28

[58] Field of Search ..... 280/11.19, 11.2, 280/11.22, 11.27, 11.28, 11.23

[56] References Cited

U.S. PATENT DOCUMENTS

| | | | |
|---|---|---|---|
| 1,616,952 | 2/1927 | Dahl | 280/11.22 |
| 2,048,916 | 7/1936 | Bentzlin | 280/11.2 |
| 3,086,787 | 4/1963 | Wyche | 280/11.19 |
| 4,272,091 | 6/1981 | Reid, Jr. | 280/11.19 |
| 4,402,521 | 9/1983 | Mongeon | 280/11.28 |
| 4,966,377 | 10/1990 | Yu | 280/11.2 |
| 5,224,718 | 7/1993 | Gertler | 280/11.19 |
| 5,263,725 | 11/1993 | Gesmer et al. | 280/11.28 |
| 5,330,208 | 7/1994 | Charron et al. | 280/11.28 |
| 5,398,949 | 3/1995 | Tarng | 280/11.22 |
| 5,421,596 | 6/1995 | Lee | 280/11.27 |

FOREIGN PATENT DOCUMENTS

| | | | |
|---|---|---|---|
| WO89/11894 | 12/1989 | WIPO | 280/11.2 |

*Primary Examiner*—Eric D. Culbreth
*Assistant Examiner*—Min Yu
*Attorney, Agent, or Firm*—Roger A. Marrs

[57] ABSTRACT

A blade roller skate having a sole plate supporting multiple rollers or wheels from its underside in downwardly depending relationship and with front rollers in linear alignment along the central longitudinal axis of the plate and rear rollers arranged in tandem separated by the central longitudinal axis. The front rollers are mounted on axles incorporating shock absorbing devices while the rear rollers are movably carried on separate axles connected to a truck which includes shock absorbing devices associated with each axle. The truck mounts the separate rear roller axles to permit independent lateral movement in response to tilting or angling of the sole plate during use of the skate.

1 Claim, 3 Drawing Sheets

10
11
12
14
15
16
17
18
20
21
22
23
24
25
26
35
38
51
2
3
4
6

SHOCK ABSORBING BLADE ROLLER SKATES

BACKGROUND OF THE INVENTION

1. Field of the Invention

The present invention relates to the field of blade roller skates, and more particularly to a novel skate having in-line rollers and tandem rollers downwardly depending from a shoe plate, and which incorporates shock absorbing means providing improved performance and increased stabilization during a skating procedure by the user.

2. Brief Description of the Prior Art

In the past, it has been the conventional practice to construct a roller skate with either a plurality of wheels arranged in-line or using tandem wheels which are arranged in-line. In either instance, the wheels downwardly depended from the underside of the shoe plate and in some instances, minor shock absorbing components are employed which usually take the form of hard rubber or the like. The use of such a shock absorbing component does not relate to the turning axles for the wheels or rollers so that an uneven distribution of load forces is transferred from the wheels or rollers through the shoe plate to the boot or shoe of the user. Also, no means are provided in conventional wheel or roller mountings which provide for independent shock capability and which include a means for preventing dust, debris or other foreign matter from interfering with the shock absorbing and load distribution function.

Therefore, a long-standing need has existed to provide a novel roller skate having shock absorbing mounting means for individual rollers or wheels that not only provide improved load force distribution but permit shock absorbing capability while the turning axes of individual independent wheels or rollers are inclined or angled with respect to the shoe plates on which the wheels are rotatably mounted. Also, means for preventing dust and debris from clogging or interfering with the smooth operation of the wheels or rollers is needed.

SUMMARY OF THE INVENTION

Accordingly, the above problems and difficulties are avoided by the present invention which provides a novel shock absorbing roller skate having rear double flexing wheels downwardly depending from the back end of a shoe plate in order to achieve over-all balance and the double flexing wheels are employed in combination with at least two front in-line wheels. Independent shock absorbing means are provided for the double flexing wheels and the front in-line wheels. Even balanced shock absorption is provided by employing two piston and cylinder assemblages for supporting the opposite ends of axles for the in-line wheel assembly. Each in-line shock assembly can be adjusted by changing the shock absorbing material which may take the form of a basic compression spring and nylon grommet or may take the form of a belleville curved and wavy spring arrangement or through the use of various thicknesses of compression springs combined with other materials to achieve a desired two-phased shock absorption. The rear double flexing wheels include a compressive shock absorbing means to accommodate angular swiveling of the rear double flexing wheels and may take the form of a pivot pin mounted in a swivel bracket having two mating side blocks providing side swivel action for the double wheels when the skater applies a leading pressure thereto. The back swivel bracket and block is supported by two heavy-duty springs on each side and the swivel block is provided with a pressure fitted rod for actual mounting of the rear side wheels. The pack assembly further includes two rubber spacers for secondary pivoting motion and a diagonal pivot pin is placed in front of the swivel bracket adjustable for the swivel assembly so as to be used on roller skates or skate boards alternately.

Therefore, it is among the primary objects of the present invention to provide a novel roller skate which incorporates shock absorbing means into rollable in-line wheels and tandem or double flexing wheels so that dirt and debris will not adversely affect the shock absorbing capability.

Another object of the present invention is to provide a novel shock absorbing system for a combination of in-line wheels and tandem wheels for a roller skate which provides improved load distribution and shock absorbing capabilities including situations in which the wheels are inclined or angularly disposed with respect to their mounting shoe plates.

Still a further object of the present invention is to provide a novel roller skate having a combination of in-line front wheels with a rear double flexing tandem wheel wherein individual and independent shock absorbing mechanisms are employed for each of the wheels.

Still another object of the present invention is to provide a novel shock absorbing system for roller skate wheels whether arranged in in-line or tandem and which permits interchangeability of wheel assemblies for use on other skates or skate boards.

Yet another object of the present invention is to employ an improved adjustable locking means for holding a double flexed wheel assembly together as a solid unit and yet which will permit removal of a locking bolt or locking pin in order to permit rapid and convenient disassembly.

A further object resides in providing a roller skate having a main,foundation block for a shock absorbing assembly that provides an even independent shock absorbing capability and which incorporates a swivel bracket and block assembly accommodating side flex movements as the wheels angle with respect to their mounting shoe plates.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
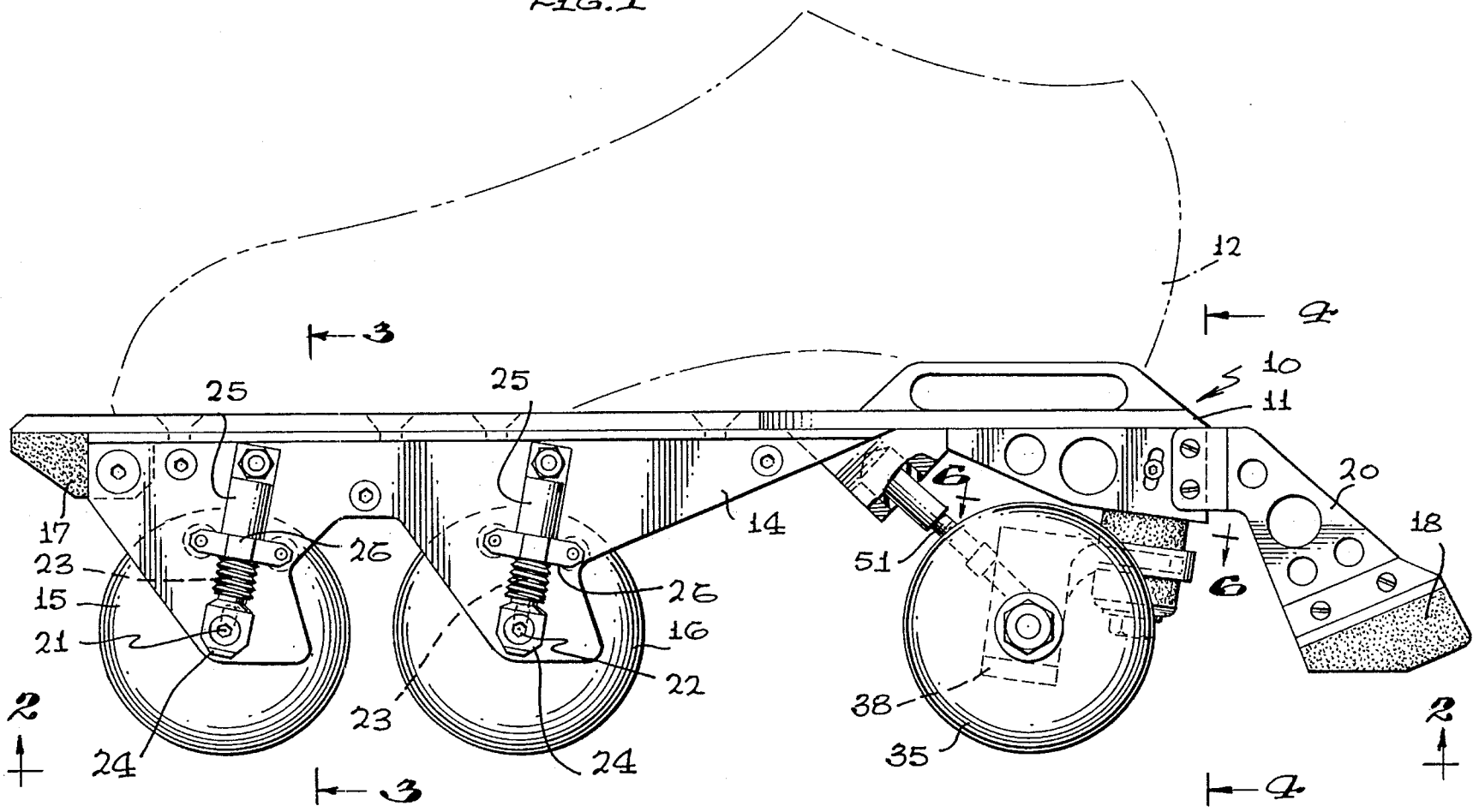
FIG. 1 is a side elevational view showing the novel roller skate of the present invention incorporating independent shock absorbing means associated with each wheel or wheel assembly.
Figure 4:
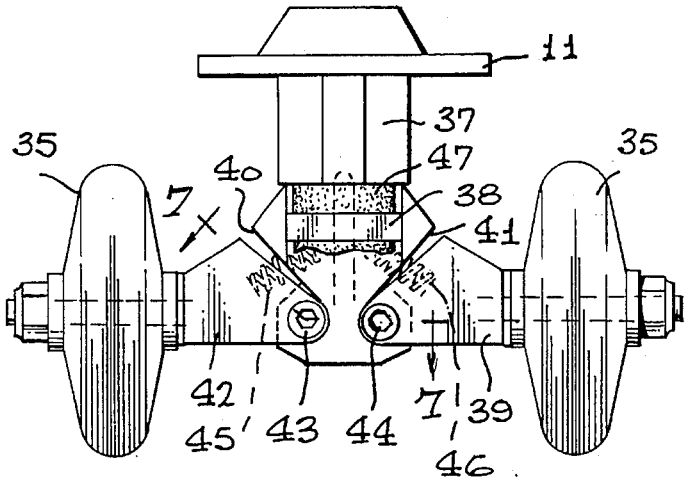
FIG. 4 is an end view, partly in sections, of the skate shown in FIG. 1 as taken in the direction of arrows 4—4 thereof.

Referring to FIG. 1, the novel shock absorbing roller skate of the present invention is illustrated in the general direction of arrow 10 which includes a shoe plate 11 on which the shoe of a skater is supported and the shoe is indicated by numeral 12. Downwardly depending from the underside of plate 11, there is provided a pair of ribs 13 and 14, see FIG. 3, which support a pair of inline wheels 15 and 16. Immediately ahead of the ribs 13 and 14, a toe stop 17 is provided and at the rear of plate 11, a heel stop 18 is provided which is attached to a support plate 20.

Figure 2:
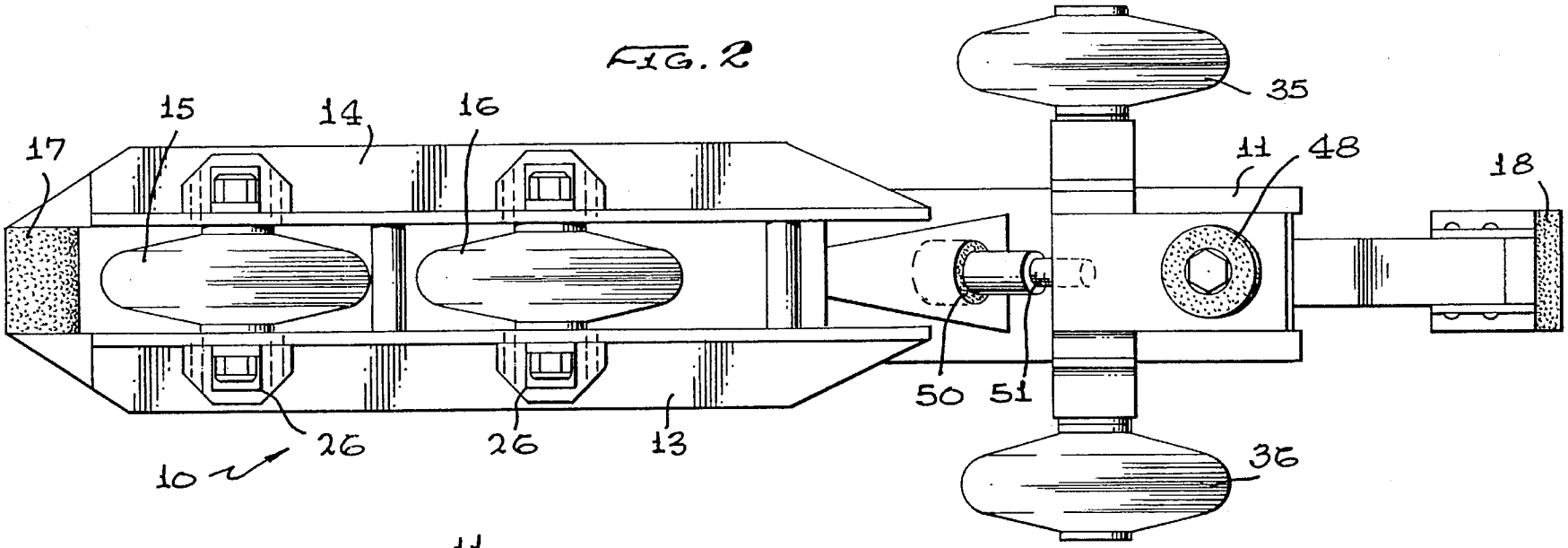
FIG. 2 is a bottom view of the skate shown in FIG. 1 as taken in the direction of arrows 2—2 thereof.
Figure 3:
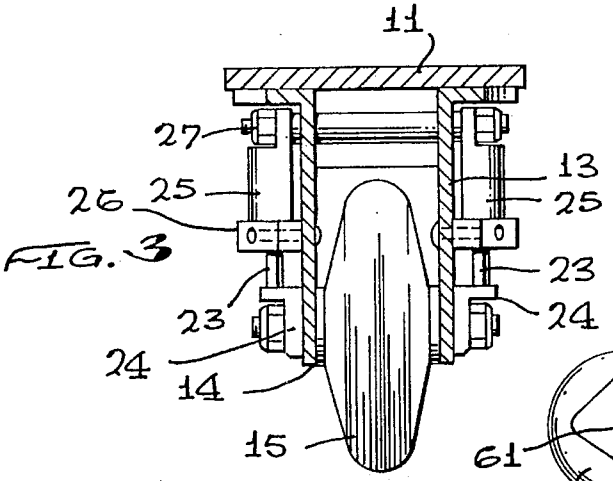
FIG. 3 is a transverse cross-sectional view of the front of the skate as taken in the direction of arrows 3—3 thereof.

The wheels 15 and 16, as shown in FIGS. 1, 2 and 3, are rollably supported between the opposing surfaces of the ribs or support plates 13 and 14 by means of axles 21 and 22 which have their opposite ends carried in bearings attached to the respective rib. The axles for each of the respective wheels are carried on the ends of pistons, such as piston 23, as shown in FIG. 3, which passes through a fixture 24 and which moves through cylinder 25. Thus, a shock absorbing marking means for the wheel is provided permitting vertical movement of the wheel between the opposite opposing surfaces of the fixture 24 and the underside of mount 26. Therefore, it can be seen that the mount 26 fixedly secures the cylinder 25 to the rail 14 while the internal piston 23 moves longitudinally through the cylinder to absorb shocks as the wheel rotates. Such independent shock absorbing mounts are provided on each side of the wheels 15 and 16. The cylinders 25 are further secured to the rails by means of fittings 27 which extend through both of the ribs 13 and 14 immediately beneath the shoe plate 11 of the skate.

Figure 5:
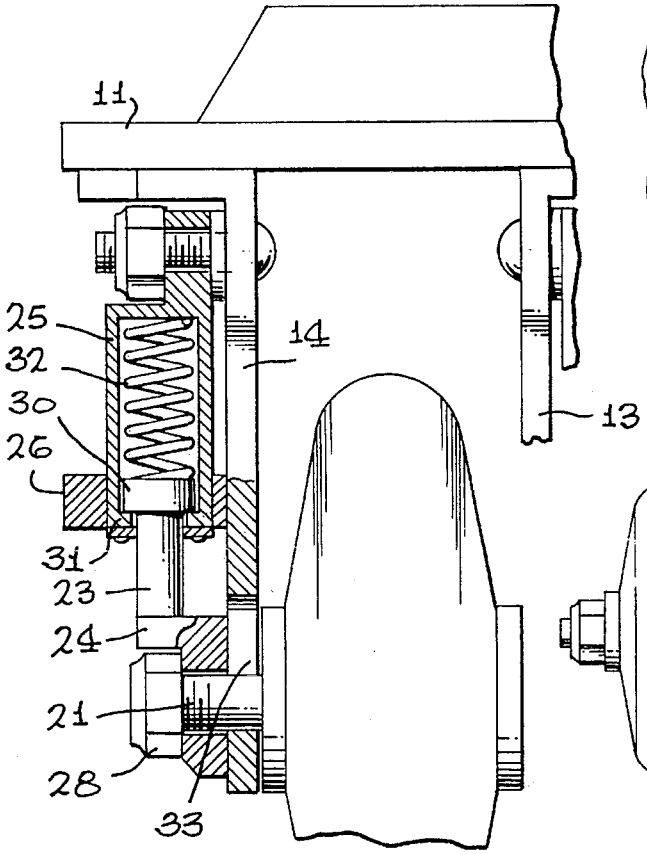
FIG. 5 is an enlarged fragmentary view, partly in sections, of a shock absorbing means mounting an in-line wheel to the sole or shoe plate.

Referring now in detail to FIG. 5, it can be seen that the fixture 24 is coupled to the axle 21 by means of securement nut 28. The opposite end of piston 23 terminates in an enlargement 30 which is located in the interior of the cylinder 25 and is forcibly urged against an annular shoulder 31 by means of expansion spring 32 within the cylinder. A slot 33 is formed in each of the ribs 13 and 14 which accommodates vertical movement of the axle 23 in response to applied load forces during use of the skate. As the axle moves upwardly, the fixture 24 and piston 23 are carried therewith against the compression of spring 32 which provides the shock absorbing and cushioning action.

Figure 6:
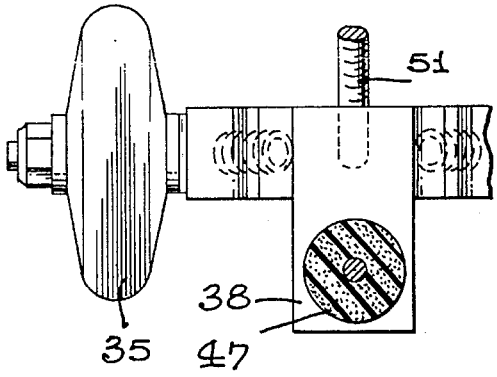
FIG. 6 is an enlarged fragmentary cross-sectional view taken in the direction of arrows 6—6 of FIG. 1.

Referring now in detail to FIGS. 1, 2, 4, 6 and 7, a mounting for tandem rear wheels 35 and 36 is illustrated which provides a shock absorbing means taking the form of a mount 37 supporting a yoke 38 having lateral cutouts 40 and 41 for accommodating axle mounts 42 and 39. FIG. 6 illustrates that the axle mounts are pivotally carried on the mount 38 by pivots 43 and 44. The axle mounts are resiliently urged outwardly by means of compression springs 45 and 46 associated with the respective axle mounts. The springs are mounted within openings in the respective axle mounts and within the mount 38. Thus, a substantial gap occurs between the opposing surfaces of the axle mounts and the mount 38 within the cutouts 40 and 41 which permits pivotal movement of the axle mounts in response to applied loads to the wheels 35 and 36. The applied loads are independent of one another permitting the shoe plate 11 to be angularly disposed with respect to the mount such as when the skater skates around corners or applies side loads to the plate 11.

Additionally, shock absorbing characteristics are provided by hard rubber or the like, as indicated by numerals 47 and 48. These shock mounting discs are more clearly illustrated in FIG. 1. FIG. 1 also illustrates the connection between the shock absorbing pads 50 by rod 51 which has its opposite end connected to the mount 38.

Figure 7:
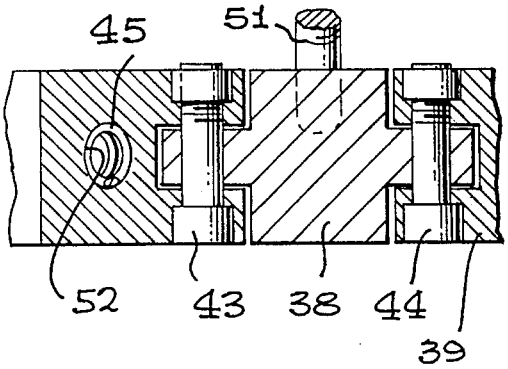
FIG. 7 is an enlarged sectional view taken in the direction of arrows 7—7 of FIG. 4.

FIGS. 6 and 7 illustrate the mount 38 and the axle mounts 42 and 39 and the aperture or hole for receiving the spring 45 is indicated by numeral 52. The pivots 43 and 44 are shown in FIG. 7 which movably connect the axle mounts 42 and 39 to the central mount 38.

Therefore, it can be seen that the novel skate of the present invention provides shock absorbing means for the inline wheels 15 and 16 as well as for the tandem or dual wheels 35 and 36. When the shoe plate 11 is laterally angled, the inline wheels 15 and 16 became a pivot about which the tandem wheels will rotate about their pivots 43 and 44. Thus, greater stability in shock absorbing capabilities is provided for the user. Also, it is to be noted that the roller skates which include rear double flexing wheels provide overall balance and combined with the two front inline wheels, provide independent shock absorbing mechanisms. These wheels and mechanisms are interchangeable for use with skateboards as well as with standard roller skates by removing the double flex assembly and changing position of the pivot pin to adapt to desired skate or skateboard applications so as to provide for increased balance and easy, faster turning ability.

The double inline wheel configuration combined with the independent shock absorbers and the shoe frame or plate will accommodate applied shocks. The frame maybe of a one-piece part that folds or a two-piece assembly that is connected by lock spacers. The rear portion of the skate mounts two-side tandem wheels supported by two swivel shock mechanisms that are held together by a geometric plate or mount 38 having tapered edges including slots in front and back to accommodate various size skate boots, shock pads or the like. Front inline assemblies are individually secured for even balanced shock absorption and each shock means is made up of two pistons with two types of spring configurations having cylinders and shock blocks to complete each of the incline shock assembly. These can be adjusted by changing the shocking material from the basic compression spring and nylon grommet to other types of curved or wavey springs or various thickness compression springs combined with other materials to achieve the desired custom two phase shock absorption. The shock absorption is achieved in two types of compression performances produced by the type of force used by the skater from extreme skating which includes angular lateral movements as well as forward and rear movements. Therein, 20 to 40% compression is used in an on and off manner. The shoe plate 11 is provided with an integrated section in the rear or back to accommodate the swivel shock assembly for the rear wheels. The back shock system consists of pivot pins mounted into swivel brackets that have two mating side blocks which provide slight side swivel action for the wheels when the skater applies leaning pressure. The back swivel bracket and block is supported by two heavy-duty springs on each side. The swivel block is provided with a pressure fitted rod for actual mounting of the rear side wheels. The back assembly also has two rubber spacers for secondary pivoting motion and a diagonal pivot pin in front of the swivel bracket is adjustable for the swivel assembly so as to be universal for most skates and skateboards.

Figure 8:
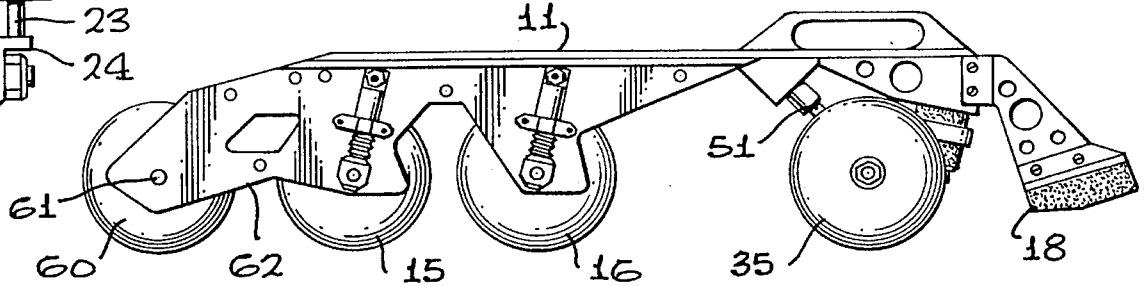
FIG. 8 is a side elevational view of another version of the inventive skate illustrating multiple in-line wheels.

Referring now in detail to FIG. 8, another version of the invention is illustrated in which a forward guide wheel 60 is in line with the wheels 15 and 16 so as to provide wheel stability. Wheel 60 is attached by pivot 61 to a front piece 62 connected or forming a part of the rails 13 and 14.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention

What is claimed is:

1. Shock absorbing blade roller skate comprising:

a shoe plate having a front end and a back end integrally connected together;

a pair of wheels downwardly depending from said front end in an in-line series spaced-apart relationship;

a pair of wheels downwardly depending from said back end of said shoe plate in a tandem parallel side-by-side, spaced-apart relationship;

shock absorbing means resiliently supporting said in-line pair of wheels to said shoe plate and resiliently supporting said tandem pair of wheels to said shoe plate;

said shock absorbing means includes a piston and cylinder assemblage wherein each piston and cylinder assemblage comprising a cylinder connected to said shoe plate and to a said piston which is connected to each wheel depending from said front end;

said pair of in-line wheels include a shock absorbing means consisting of said piston and cylinder assemblage resiliently connecting each wheel of said pair of in-line wheels to said shoe plate;

said pair of tandem wheels include a shock absorbing means consisting of a pair of coil springs laterally expanding between said tandem wheels and said shoe plate at an angular disposition so as to permit rotation of said shoe plate about a longitudinal axis extending along the length of said shoe plate;

said tandem wheels are mounted on axle mounts which are pivotally mounted on a block by pivots; and said block includes a recess occupied by said coil spring on each side of said block.

* * * * *